United States Patent [19]

Riblet

[11] 4,041,420

[45] Aug. 9, 1977

[54] SHUNTED STEPPED WAVEGUIDE TRANSITION

[76] Inventor: Henry J. Riblet, 100 Westcliff Road, Weston, Mass. 02193

[21] Appl. No.: 701,303

[22] Filed: June 30, 1976

[51] Int. Cl.[2] ..... H01P 5/08

[52] U.S. Cl. ..... 333/35; 333/98 R

[58] Field of Search ..... 333/35

[56] References Cited

U.S. PATENT DOCUMENTS

| | | | |
|---|---|---|---|
| 2,432,094 | 12/1947 | Fox | 333/35 |
| 3,364,383 | 1/1968 | Cooper | 333/35 X |

*Primary Examiner*—Paul L. Gensler

*Attorney, Agent, or Firm*—Wolf, Greenfield & Sacks

[57] ABSTRACT

A transition device for joining waveguides of different characteristic impedances employs one or more sections that are stepped in height in the manner of a quarter wave transformer. Each of the sections is approximately a quarter wavelength long. A resonant element is situated at the low impedance end of the transition device. The element is resonant at a frequency within the pass band of the transition device. The invention provides improved performance over that obtained with a conventional quarter wave transformer of approximately the same length.

3 Claims, 6 Drawing Figures

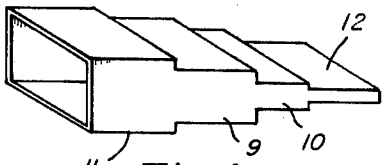
Fig. 1 PRIOR ART
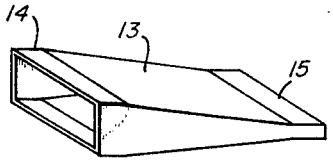
Fig. 2 PRIOR ART
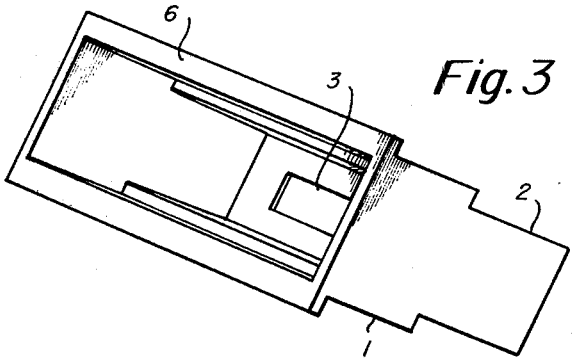
Fig. 3
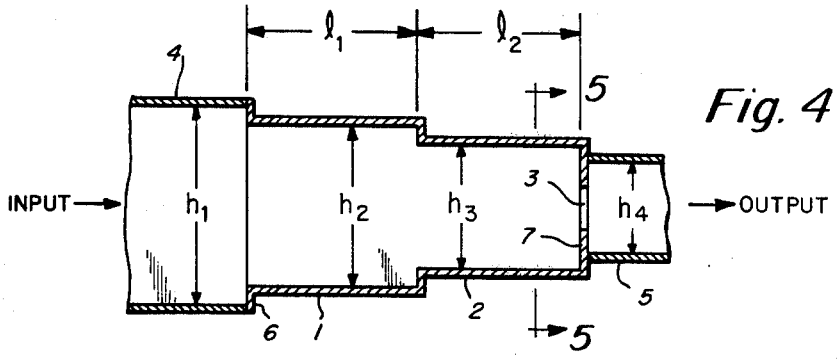
Fig. 4
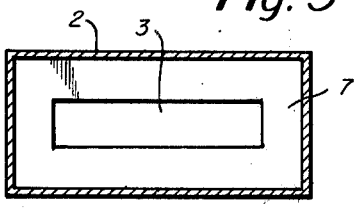
Fig. 5
Fig. 6
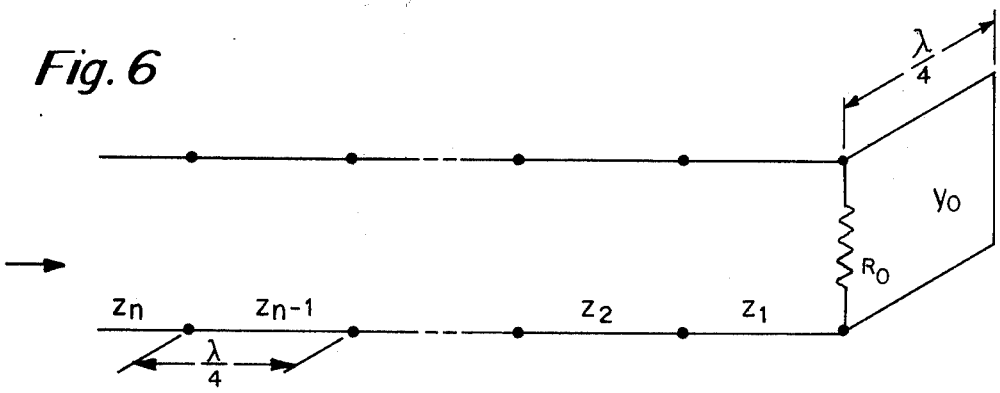

SHUNTED STEPPED WAVEGUIDE TRANSITION

FIELD OF THE INVENTION

In systems employing waveguides for the transmission of electromagnetic waves, it is often necessary or desirable to pass from one size or form of guide to another. For example, it may be necessary to transfer wave energy from one waveguide to a waveguide of different characteristic impedance. This occurs where wave energy propagating in a rectangular waveguide is transferred to a rectangular waveguide of different height. To minimize the reflection of the wave energy at the junction of the different height waveguides, it is customary to provide a matching device. For acceptable performance, the device must act as an impedance transformer when it joins guides of different characteristic impedance.

DESCRIPTION OF THE PRIOR ART

Heretofore the transition from a rectangular waveguide of one height to a rectangular waveguide of another height has been accomplished by disposing between the two waveguides a rectangular waveguide "transition" having a series of stepped sections whose heights are intermediate the height of the taller waveguide and the lesser height of the other waveguide. For a transition having a single stepped section, the height of the section is determined by choosing the characteristic impedance of the stepped section to be the geometric mean of the characteristic impedances of the two rectangular waveguides which the transition joins. Generally, the stepped sections are each a quarter wavelength in length at the mid-band frequency or very near to it because at that length the reflections from the steps at the two ends of the section tend to cancel. The small parasitic shunt capacitances associated with the steps in a waveguide transition are usually compensated by a slight change in the length of the stepped section. Consequently, in the conventional quarter wave transformer made of waveguide, the stepped section of highest height is somewhat longer than a quarter wavelength, the stepped section of lowest height is somewhat less than a quarter wave in length, and the other stepped sections are of intermediate lengths. Of course, a quarter-wave transformer cannot be perfectly matched at all frequencies over its design band. However, when a sufficient number of stepped sections are placed in tandem, a satisfactory match can be obtained with the conventional quarter wave transformer to make its performance acceptable for most waveguide applications.

An alternative to the quarter wave transformer which has been available for many years, is the transition section that gradually tapers from the higher height to the lower height. To be moderately free of reflections, the tapered transition section must be substantially longer than a quarter wave transformer. Presumably, the more gradual the taper, the more smoothly is the transition from one height to another and consequently the better is the match.

OBJECTS OF THE INVENTION

The principal objective of the invention is to provide an improved transition for joining the waveguides of different height which gives improved performance over that obtained with the conventional quarter wave transformer of approximately the same length.

SUMMARY OF THE INVENTION

The invention resides in a rectangular waveguide transition which is stepped in height in the manner of a quarter wave transformer and which is provided with a waveguide window at the low impedance end. The waveguide window is resonant at a frequency within the pass band of the transition and acts to shunt the load at the output end of the transition. The introduction of the waveguide window requires a slight shortening in the length of the stepped sections so that each section is somewhat less than a quarter wave in length at the mid-band frequency of the device.

While the number of sections in the transition is a matter of choice, it is in most instances desired to make the transition as short as possible consistent with acceptable performance. For maximum shortness the transition would consist of but one stepped section. However, the shortest transition may not provide acceptable performance.

The invention is herein described as embodied in a transition having two stepped sections. However, it can readily be anticipated that situations will occur where a transition having a single section will perform adequately and that in other situations a transition having more than two sections will be required.

BRIEF DESCRIPTION OF THE DRAWINGS

FIG. 1 depicts a "prior art" quarter wave transformer disposed as the transition between hollow rectangular waveguides of different heights.

FIG. 2 is a perspective view depicting hollow rectangular waveguides of different height having disposed between them a "prior art" transition of the type that gradually tapers in height.

FIG. 3 is a perspective view of the preferred embodiment of the invention,

FIG. 4 is a side view showing the interior of the preferred embodiment,

FIG. 5 is a view taken along the plane 5—5 of FIG. 4 and shows the waveguide window at the end of the transformer, FIG. 6 is a schematic depiction of a transmission line transformer having a cascade of quarter wave line sections terminated by a load shunted by a quarter wave short circuited stub.

DETAILED DESCRIPTION OF PRIOR ART TRANSITIONS

FIG. 1 depicts a conventional quarter wave transition having stepped sections 9 and 10 disposed between a waveguide 11 of larger height and a waveguide 12 of smaller height. Improved matching is obtained by making each of sections 9 and 10 a quarter wave long and selecting the heights of the sections to cause the reflections from the three steps at two frequencies in the design band to cancel.

FIG. 2 depicts a conventional tapered transition section 13 which gradually tapers from the larger height of waveguide 14 to the smaller height of waveguide 15. The tapered section must be substantially longer than a quarter wave to be moderately free of reflections. In volume 9 of the M.I.T. Radiation Laboratory Series, at page 363, it is stated that the tapered transition has the least reflections when its length is an integral number of half wavelengths. Presumably, the longer the tapered section, the smoother is the transition and the better is the match.

In the design of waveguide transmission systems, space is often a critical factor which precludes the use of the longer tapered transition section. Consequently, for such applications, the quarter wave transformer is often the only practical alternative.

DETAILED DESCRIPTION OF THE INVENTION

This invention is concerned with a waveguide impedance transformer that enables a waveguide of one characteristic impedance to be coupled to a waveguide of a different characteristic impedance in a manner effecting the efficient transfer of electromagnetic wave energy therealong. The impedance transformer of the invention is optimum in the sense that no other form of transformer is known that will perform as well in so short a length.

FIG. 3 is a perspective view of a shunted stepped waveguide transition constructed in accordance with the invention. Although the transition shown in FIG. 3 has two sections 1 and 2, the invention can be embodied in a device having one section or in a device having three or more sections. The waveguide transition of the invention is similar to the conventional quarter wave transformer in that the device is stepped in height by sections that are approximately one quarter wavelength long. The unconventional feature of the stepped transition shown in FIG. 3 is the waveguide window 3 at the end of the device. The waveguide window permits a better match to be achieved than can be obtained with the conventional quarter wave transformer of approximately the same length.

Referring now to FIG. 4 which shows a cross-sectional view of the device of FIG. 3 disposed between an input waveguide 4 of height $h_1$ and an output waveguide 5 of height $h_4$, it can be seen that the section 1 has a flange 6 to which the waveguide 4 is secured. While not shown, the flange 6 can be provided with locating means to insure that the input waveguide is properly positioned on the flange. Section 1 is essentially a hollow rectangular waveguide of height $h_2$ and adjoins the section 2 which is a hollow rectangular waveguide that is stepped down in height to the height $h_3$. At the output end of section 2, waveguide window 3 is disposed immediately in front of the output waveguide 5 which is of height $h_4$. Proceeding from the input end and considering each abrupt change in waveguide height to be a "step", three steps are utilized to effect the reduction from height $h_1$ to height $h_4$. The distance between adjacent steps is approximately a quarter wave in length at the mid-band frequency of the transformer. Considering each section to be the length of guide between adjacent steps, the length of section 1 is indicated by $l_1$ and the length of section 2 is indicated by $l_2$.

As shown in FIG. 5, the waveguide window 3 is a preferably rectangular opening in a plate 7 at the output end of the transition. The waveguide window, in effect, inserts a frequency variable admittance that shunts the low impedance end. The window, may of course, take shapes other than rectangular, without altering its admittance and the window may consist of more than one opening. To insure that the output waveguide 5 is properly located, the plate 7 can be provided with alignment means to assist in positioning the output waveguide in relation to the window.

Consider a matching transformer, as schematically depicted in FIG. 6, situated between a load impedance $R_o$, assumed to be less than one and a generator of unity impedance where the transformer consists of (1) a cascade of line sections, each line section being a quarter of a wavelength long at the mid-band frequency of the transformer and each line section having a different characteristic impedance and (2) a stub that is directly in parallel with the load $R_o$ whose admittance is denoted by $Y_o$.

For a two to one impedance transformation, with the shunted stepped type of device here considered a VSWR of less than 1.03 over a waveguide band can be achieved with a two section transformer. In the interest of clarity, the analysis presented herein is limited to that simple case.

General design formulas are set forth herein for a two section transformer with optimum equi-ripple performance over the design band. For an octave band and a two to one transformation, the optimum stepped shunted transformer has substantially superior performance to that of a conventional stepped transformer of approximately the same length.

Employing the frequency variable $t$, where $t = \cot\theta$ and $\theta = 2\pi(\overline{\lambda g}/\lambda g)$ ($\overline{\lambda g}$ is the mean guide wavelength and $\lambda g$ is the frequency variable wavelength in the guide), then the insertion loss function $P_L$ of the network is given by $$P_L = 1 + \frac{A^2 + B^2}{4R_0(1 + t^2)^2} \tag{1}$$

where $$A = [R_0Y_0(Z_1 + Z_2) + R_0 - 1]\,t^2 + \frac{Z_1}{Z_2} - R_0\frac{Z_2}{Z_1}$$

and $$B = R_0Y_0t^3 - [R_0(Y_0\frac{Z_1}{Z_2} + \frac{1}{Z_1} + \frac{1}{Z_2}) - Z_1 - Z_2]t$$

The problem of optimizing the performance of the transformer is thus the problem of minimizing the value of the fraction in (1) over the frequency band of interest.

By putting $Y_o = 0$ and requiring that $R_o = Z_1 Z_2$, $B \equiv O$, and it is found that the constant term in A can be chosen so that $A/(1 + t^2)$ is equi-ripple over the design band by the proper choice of $Z_1$ and $Z_2$. This is the well known design procedure for optimizing a two section quarter wave transformer. It is a point of interest that for $R_o = 0.5$, such a transformer will have a VSWR of about 1.13 over a waveguide band.

On the other hand, if $Y_o$ is not put equal to zero, there are three unknown with which to make $A \equiv O$ and arrange so that $B/(1 + t^2)$ is optimum equi-ripple over the design band. The three simultaneous equations can be solved explicitly for $Y_o$, $Z_1$, and $Z_2$ and then the maximum VSWR over the design band can be readily found. For the particular example under consideration, the approximate values of $Y_o$, $Z_1$, and $Z_2$ are 0.66, 0.62 and 0.88 respectively, and the maximum VSWR is less than 1.026 over the octave band. It can now be appreciated how the introduction of a stub in front of the load improves the performance of the stepped transformer.

The foregoing analysis is based upon a transmission line model in which the quarter wave shorted stub is a resonant element. A resonant waveguide window does not have the same frequency behavior as a shorted stub so that the transmission line prototype parameters have to be modified somewhat in the case of the waveguide transition. In practice, this has resulted in a slight shortening of the lengths of the waveguide sections and as a result the waveguide sections are somewhat shorter than a quarter wavelength long for optimum performance. In the two section waveguide transformer previously referred to, the length of one section is approximately 0.24 $\lambda g$ and the length of the other section is approximately 0.23 $\lambda g$. Of course, the lengths of the sections can be altered somewhat where a departure from the optimum is acceptable.

Perhaps the most common configuration of a resonant waveguide window is an iris of simple rectangular form. There are, of course, other forms of resonant irises and it is not therefore intended to limit the invention to any specific form of resonant window.

What is claimed is:

1. In a stepped transformer of the type having one or more sections of waveguide that are each substantially one quarter wavelength long at the mid-band frequency of the transformer, the improvement comprising a resonant element which provides a non-zero admittance shunting the lowimpedance end of the transformer, the resonant element being a window disposed at one end of a section of rectangular waveguide, and the integrated width and the integrated height of the window being less than the corresponding internal dimensions of the waveguides on both sides of the window.

2. In a transformer for joining rectangular waveguides of different characteristic impedances, the transformer being of the stepped type having one or more sections of rectangular waveguide that are each substantially one quarter wavelength long at the transformer's mid-band frequency, the improvement of a waveguide window at the low impedance end of the transformer, the window being resonant at a frequency within the transformer's pass band, and the integrated height and the integrated width of the window being less than the corresponding internal dimensions of the rectangular waveguides on both sides of the window.

3. In a stepped waveguide transformer for joining waveguides of different characteristic impedances, the transformer being of the type having a series of steps separated by sections of hollow tubing, each section being about a quarter wavelength long and the areas of the openings at the steps being progressively smaller looking from the larger end of the transformer toward the other end, the improvement wherein the last step constitutes a window that is resonant within the pass band of the transformer, the integrated height and the integrated width of the window being less than the corresponding internal dimensions of the waveguides on both sides of the window.

* * * * *